US007481783B1

(12) United States Patent
Kelley

(10) Patent No.: US 7,481,783 B1
(45) Date of Patent: Jan. 27, 2009

(54) HOT OR COLD MASSAGE THERAPY ROLLER

(75) Inventor: Jerry S. Kelley, Akron, OH (US)

(73) Assignee: Polar Products, Inc., Akron, OH (US)

( * ) Notice: Subject to any disclaimer, the term of this patent is extended or adjusted under 35 U.S.C. 154(b) by 1653 days.

(21) Appl. No.: 09/907,108

(22) Filed: Jul. 17, 2001

(51) Int. Cl.
*A61H 15/00* (2006.01)
*A61H 15/02* (2006.01)

(52) U.S. Cl. ..... 601/15; 601/17; 601/128; 601/129; 601/131; 601/135

(58) Field of Classification Search ..... 601/15, 601/17–19, 118, 131, 135, 128, 129; 401/209, 401/6, 185, 208; 607/114, 147
See application file for complete search history.

(56) References Cited

U.S. PATENT DOCUMENTS

| | | | | |
|---|---|---|---|---|
| 622,350 | A | | 4/1899 | Hanks |
| 769,463 | A | | 9/1904 | Blanchard |
| 1,270,635 | A | | 6/1918 | Ljungstrom |
| 1,947,042 | A | | 2/1934 | Glennan |
| 2,787,261 | A | | 4/1957 | McDonald et al. |
| 3,382,866 | A | | 5/1968 | Harris |
| 4,082,089 | A | * | 4/1978 | Moriyama et al. ..... 601/19 |
| 4,745,909 | A | * | 5/1988 | Pelton et al. ..... 601/15 |
| 5,127,395 | A | | 7/1992 | Bontemps |
| 5,662,593 | A | | 9/1997 | Tillman et al. |
| 6,093,159 | A | | 7/2000 | Racoosin |
| 6,129,687 | A | | 10/2000 | Powell et al. |
| 6,241,696 | B1 | * | 6/2001 | York ..... 601/137 |

FOREIGN PATENT DOCUMENTS

| | | | | |
|---|---|---|---|---|
| FR | 2605518 | * | 4/1988 | ..... 601/131 |

* cited by examiner

*Primary Examiner*—Danton DeMille
(74) *Attorney, Agent, or Firm*—John D. Gugliotta

(57) ABSTRACT

A massage device for providing cold or hot massage therapy including a liquid reservoir and a rotatable ball positioned in an open end of the reservoir. The reservoir is at least partially filled with a liquid that is heated or cooled. The liquid in the massage device is heated or cooled. The rotatable ball is heated or cooled through heat transfer between the liquid and the rotatable ball. Massage therapy can be provided using both the reservoir portion and/or the rotatable ball of the massage device.

13 Claims, 3 Drawing Sheets

HOT OR COLD MASSAGE THERAPY ROLLER

TECHNICAL FIELD

The present invention relates to a device for providing massage therapy. More specifically, the present invention is a massage device capable of providing a roller massage and a kneading massage in conjunction with heat or cold therapy.

BACKGROUND

Physicians, physical therapists, chiropractors, sports trainers, massage therapists and many others often provide massage therapy to patients, athletes or clients. In addition, massages and cold therapy are often given by people with no special training in homes by family members or others. Often heat or cold therapy is combined with the massage to soothe or stimulate muscles. In addition to heat and/or cold therapy, different types of massage techniques may be used. For instance, targeted pressure therapy may be used to provide a pinpoint muscle massage to a certain spot in a muscle group. In other cases a more broad based "kneading" type massage is needed.

In order to impart cold therapy with the targeted pressure type massage, therapists and others would often encase water in a small vessel, insert a stick or similar handle implement, and then freeze the water. The result was a POPSICLE™ like configuration. The frozen water mass on the end of the handle implement was used to massage particular points on a person's body. Massages using this technique could be messy. As the person's body heat and the ambient temperature melted the ice, water would drip over the person and potentially on to the table, bed or floor around where the massage was being administered.

For kneading type massages, ice packs or ice cubes could be used to assist with these types of massages, but these could be messy and inconvenient. In addition, massaging over an ice pack does not provide the direct cold treatment that may be needed.

SUMMARY

In view of the limitations of the prior art, the present invention provides a massage device comprising a reservoir, having a closed end and an open end, which is capable of holding a quantity of liquid therein. A rotatable ball is positioned in the open end of the reservoir. A part of the ball projects or extends out of the open end of the reservoir at least a short distance. The ball is preferably capable of rotating freely within the end of the reservoir. The ball may be positioned directly in the end of the reservoir or a sleeve or other similar mechanism may be used to secure the ball in the end of the reservoir and to allow free rotation of the ball. The positioning of a ball or ball assembly in the end of the reservoir may be used to substantially prevent the escape of liquid from the reservoir through the end of the reservoir in which the ball is positioned.

The ball is positioned in the reservoir such that heat transfer can occur between the ball and the liquid contained in the reservoir. Thus, if the liquid in the reservoir is cooled, the ball will be cooled and can be used to provide cold massage therapy. If the liquid in the reservoir is heated, the ball will be heated to provide heated massage therapy. The heat or cold transfer can occur through a sleeve in which the ball is positioned or directly between the liquid and the ball. In addition, the closed end of the reservoir can also be used to provide massages and take advantage of the temperature of the liquid in the ball.

A method of using the massage device of the present invention is also provided.

DETAILED DESCRIPTION OF THE INVENTION

The present invention will be described in relation to the attached FIGURES. It should be understood that variations on the embodiments shown and described herein are within the scope of the present invention and should be covered by the claims herein.

Figure 1:
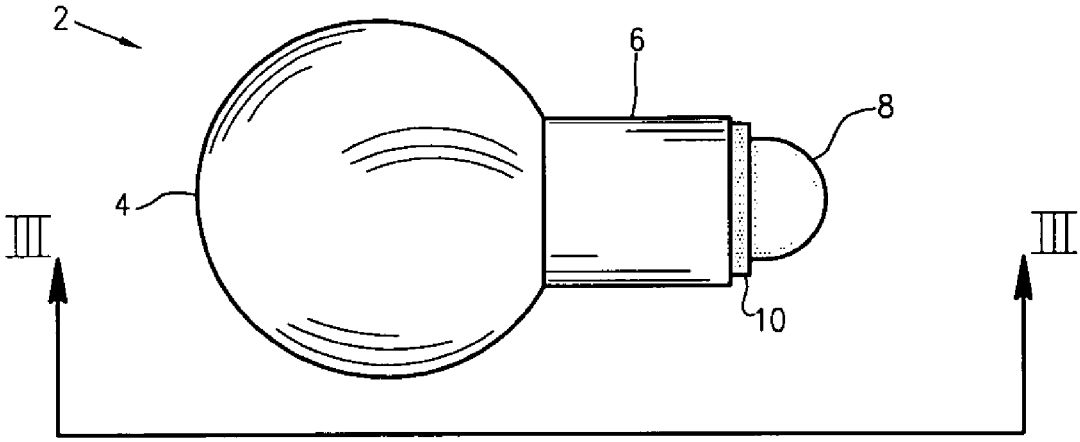
FIG. 1 illustrates a side view of a massage device in accordance with the present invention.
Figure 2:
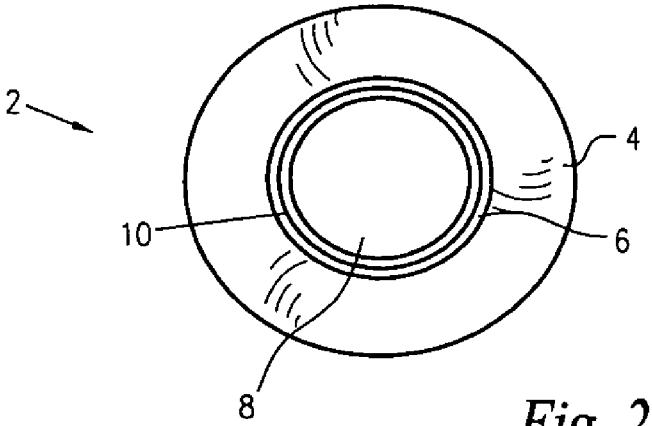
FIG. 2 is a top view of a massage device in accordance with the present invention.
Figure 3:
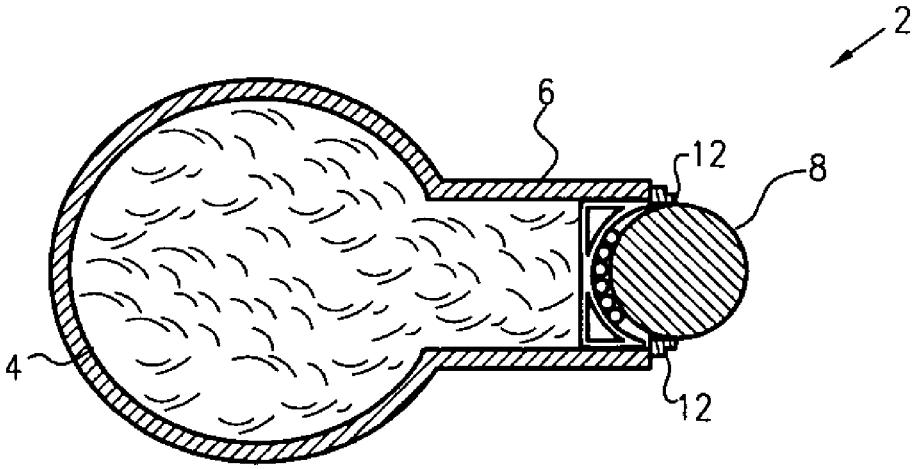
FIG. 3 is a cross-sectional view of FIG. 1, taken alone line III-III, illustrating the barrier 12 placed within the neck 6 and the ball 8 and assembly 10.
Figure 4:
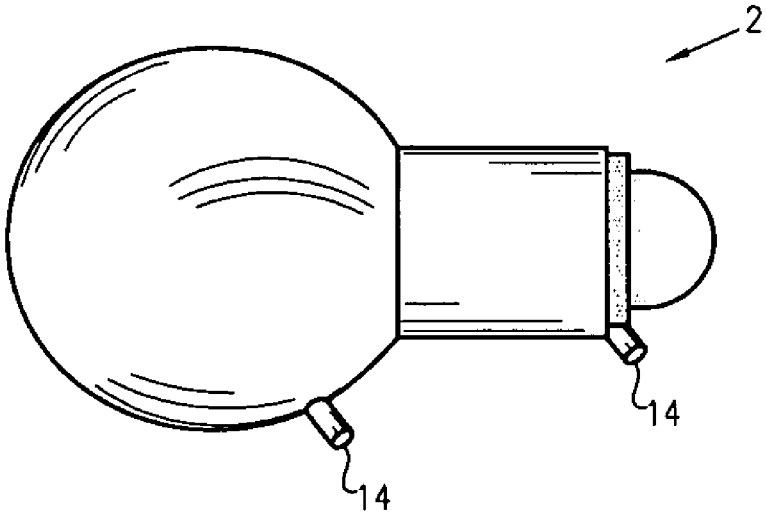
FIG. 4 is a side view of a massage device having at least one valve 14 at either the reservoir 4 and/or the ball 8 and assembly 10.

FIG. 1 illustrates one embodiment of a massage device, which may be used to impart cold therapy, generally designated 2, of the present invention. The massage device comprises a reservoir portion which has a closed, bulbous lower end 4 and a narrowed neck portion 6. The bulb 4 is shown as a spherical bulb, however, it should be understood that the bulb could take on various shapes such which could effectively provide massages. For instance, the lower portion of the bulb could be flat, oval or even triangular for use in providing massage or cold therapy. In addition, as the bulb portion 4 may also be considered as having the main purpose of acting as a handle for the roller ball 8, the bulb could take on irregular shapes. For example, the bulb could be shaped as the head of an animal or cartoon character in a novelty massage or cold therapy device. Alternatively, the bulb could be decorated with various designs or have decorative shapes, such as fruit shapes or as other common articles. The only limitation on the shape of the bulb is that it must be able to hold a quantity of liquid and roller type ball implement in an end thereof.

The reservoir 4 or bulb may be fabricated of various materials, preferably the materials are flexible and have some insulating capabilities. For instance, the bulb may be made of materials including but not limited to natural rubber, synthetic rubber, polyurethane, polyvinyl chloride, or polyethylene. In a preferred embodiment, the bulb is made of a flexible material capable of withstanding low temperatures without cracking, tearing or breaking. A flexible bulb is also preferred for freezing the liquid within the reservoir. Water is one liquid potentially placed in the reservoir in the present invention. When frozen, the water expands and occupies more volume. Thus, in a preferred embodiment, the material used for the bulb is capable of expanding at least a small amount to accommodate a phase change of the liquid therein.

The massage or cold therapy device also comprises a roller ball assembly. In a preferred embodiment, the roller ball assembly is comprised of a ball 8 and a sleeve 10. The ball 8 is positioned within the sleeve 10 so that at least the ball 8 projects at least a short distance out of the end of sleeve 10. The ball 8 is capable of rotating freely within sleeve 10.

Sleeve is positioned within neck 6 of reservoir. In a preferred embodiment, the neck of reservoir covers most of sleeve to provide insulation to the sleeve 10 so that ball 8 can better retain the heat or cold for a length of time of a massage.

In another embodiment, a ball can be positioned directly in the end of neck of the reservoir.

The ball 8 or ball assembly 8 and 10, preferably has a diameter just slightly smaller than the diameter than the neck of the reservoir or the sleeve, so that the ball assembly fits tightly within the neck 6 of reservoir 4. The ball assembly should substantially prevent liquid from flowing out of the reservoir. This may be accomplished by sleeve having a barrier 12 at or near the end of the sleeve which is inserted in the neck of the reservoir. The barrier 12 is preferably of the same or similar material as the ball and sleeve. The barrier 12 should be of a material and positioned in the end of the sleeve such that it allows and/or facilitates conduction of heat or cold between the sleeve and ball. Another embodiment of the present invention including a roller ball may allow the escape of some liquid for therapeutic purposes. Such an embodiment may include a valve 14, or a plurality of valves, for refilling or replenishing the liquid supply within the ball for future uses.

The ball assembly is preferably made of metal which has good heat and cold conduction ability. In this way, cold or heat is best transferred from the liquid in the reservoir to the sleeve and ball for providing cold or hot therapy. The ball may also be comprised of plastics which could also be used to conduct hot or cold therapy in the massage or cold therapy device. If the ball portion is comprised of plastic, it is preferred that the plastic be a rigid plastic for proper delivery of the targeted pressure therapy.

In a preferred embodiment of the present invention, the ball is a solid metal or plastic ball. In another embodiment, the ball may be hollow. The hollow ball may optionally be filled with a liquid material that is capable of being cooled or heated to provide massage or cold therapy of an appropriate temperature. The filled hollow ball may be used in conjunction with a bulb or reservoir with or without liquid contained therein.

In a preferred embodiment of the present invention, the liquid contained in the reservoir or ball is water. The water may distilled, deionized, be from a spring or simply be tap water. The only requirements are that there be no additives or contaminants in the water that may cause any deterioration of any of the components of the massage device, in particular the reservoir or the ball assembly. In addition, if liquid is allowed to escape from the reservoir to contact a person's skin, it is preferred that any additives be nontoxic and not be known to cause skin irritations.

In an alternative embodiment of the present invention, the liquid contained in the reservoir may be known lotions or oils used in massage therapy. This embodiment would be of a type where at least some liquid is allowed to escape from the reservoir through a rotatable ball assembly.

It is also contemplated by the present invention that water in the reservoir or ball contain various additives that will raise or lower the freezing point of the water and or create a slower solid to liquid or liquid to gas phase changes. Such additives will allow a user of the device to control the temperature of the massage device to help reach optimum therapeutic effect. It is also contemplated that the liquid in the present invention be eutectic cooling mixtures. Examples of such mixtures include but are not limited to mixtures of alkaline earth salts such as magnesium chloride, magnesium perchlorate and sodium chloride. Such eutectic cooling mixtures can be cooled to temperatures lower than 0° C., and thus may provide more effective cold massage therapy.

The massage device of the present invention is cooled or heated to provide massage therapy. The entire massage device may be placed in a freezer or refrigerator to cool the liquid in the device. The massage device may also be immersed in a hot or cold liquid. It is also contemplated that massage device in accordance with the present invention be made having components that can safely be heated in a microwave or conventional oven. Other known methods by which the liquid in the massage device may be heated or cooled are within the scope of the present invention.

In another embodiment of the present invention, the reservoir, the ball or both may comprise a valve 14 for emptying or filling the reservoir or ball with a liquid. The valve 14 should be positioned on any of these components such that it does not interfere with the massage therapy. A massage device having one or more valves 14 could be heated or cooled by any of the methods described above. In the alternative, however, an embodiment of the massage device containing a valve 14 could also be filled with a liquid of the appropriate temperature at the time of a massage. Thus, heating or cooling is accomplished by introducing the liquid into the reservoir or ball and no external heat source is necessary.

Various methods of using the massage device of the present invention are contemplated. First, the ball may be provided with a liquid already therein or may be filled with a liquid. If the liquid is not already at an appropriate temperature for the needs of a particular massage, the massage device may be placed in a refrigerator or freezer, immersed in hot or cold liquid, placed in an oven, or heated or cooled by any other known means. Once the liquid in the massage device is at an appropriate temperature, the ball portion of the device may be used to provide targeted massage therapy, or the bulb or reservoir portion may be used to provide "kneading" massage therapy.

In another embodiment of the present invention, the ball and/or ball assembly may be magnetized or have a positive or negative electrical charge imparted thereto. Such a charge may have additional therapeutic effects in addition to the hot or cold therapy massage.

Figure 5:
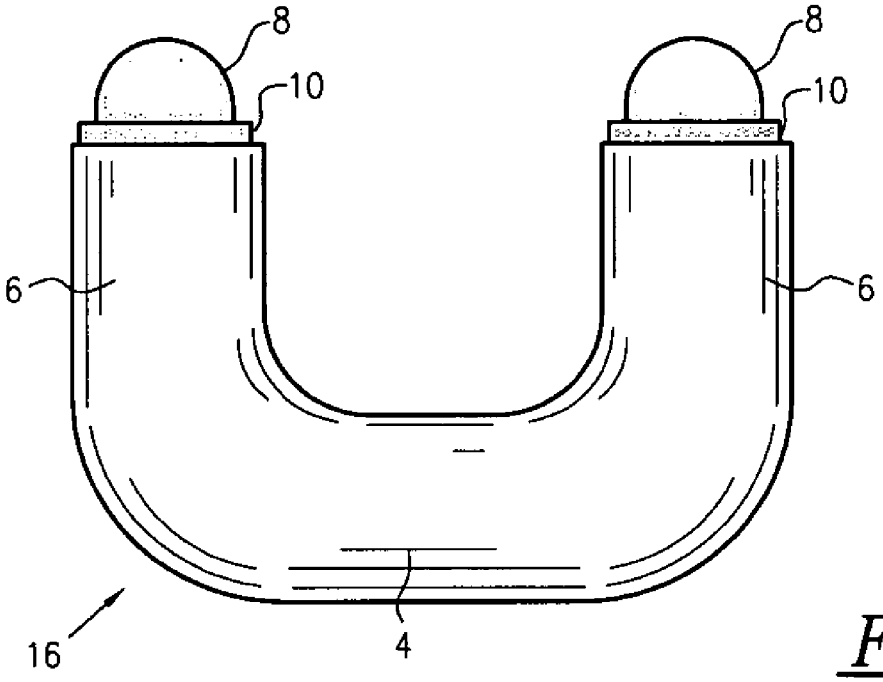
FIG. 5 is an alternative embodiment of the massage device having a U-shape with a reservoir 4 and a plurality of necks 6.
Figure 6:
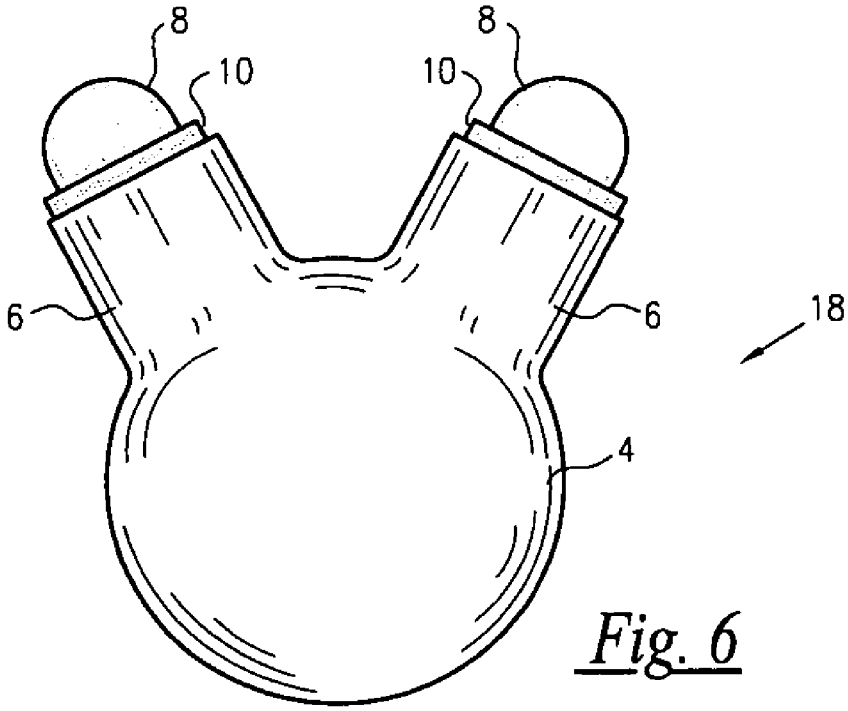
FIG. 6 is an alternative embodiment of the massage device having a bulbous reservoir 4 with a plurality of necks 6.

In another embodiment, the massage or cold therapy device may also have more than one roller ball assembly to target more than one location on a person's body. For instance, a reservoir may be formed in a U shape (see FIG. 5), generally labeled 16, with a roller ball assembly on each end for imparting targeted massage or cold therapy to two points on a body. Such an embodiment could be used to provide therapy to both sides of vertebrae or spine. Another alternative embodiment may comprise a bulbous reservoir with "limbs" (see FIG. 6), generally labeled 18, or extensions projecting therefrom, with each extension having a roller ball assembly positioned in an end thereof to provide targeted massage or cold therapy.

The present disclosure describes preferred embodiments of the present invention. The scope of the present invention is described in the following claims. Variations on the embodiments described herein are considered to be within the scope of the claims.

What is claimed is:

1. A massage device comprising:

a reservoir comprising a bulb having a neck portion;

a liquid filling at least a portion of said reservoir; and a roller ball assembly comprising a cylindrical sleeve having a first open end and a second end and a rotatable ball, wherein said rotatable ball is positioned within said sleeve such that at least a portion of said ball projects through said first open end and wherein said second end of said sleeve is inserted into said neck portion such that heat transfer can occur between at least a portion of said roller ball assembly and said liquid;

wherein said second end of said sleeve comprises a barrier to substantially prevent said liquid from flowing out of said reservoir.

2. The massage device as recited in claim 1 wherein said liquid is frozen.

3. The massage device as recited in claim 2 wherein said reservoir is fabricated of a member of the group consisting of natural rubber, synthetic rubber, polyurethane, polyvinyl chloride, and polyethylene.

4. The massage device as recited in claim 1 wherein said liquid is water.

5. The massage device as recited in claim 1 wherein said roller ball assembly is fabricated of metal.

6. The massage device as recited in claim 1 wherein said reservoir further comprises:

a valve for emptying liquid from said reservoir and refilling said reservoir with liquid.

7. The massage device as recited in claim 1 wherein said rotatable ball has a magnetic charge.

8. A massage device comprising:

a liquid reservoir having at least one arm projecting therefrom, said arm having an open end;

a liquid filling at least a portion of said liquid reservoir; and a roller ball assembly inserted in said open end of said at least one arm, such that said roller ball assembly projects through said open end of said at least one arm, said roller ball assembly positioned in said end of said arm such that heat transfer can occur between said ball and said liquid;

a cylindrical sleeve having a first open end and a second end;

a rotatable ball is positioned within said sleeve such that at least a portion of said ball projects through said first open end and wherein said second end of said sleeve is inserted into said open end of said at least one arm;

wherein said second end of said sleeve comprises a barrier to substantially prevent said liquid from flowing out of said reservoir.

9. The massage device as recited in claim 8 wherein said roller ball assembly is fabricated of metal.

10. The massage device as recited in claim 8 wherein said roller ball assembly has a magnetic charge.

11. The massage device as recited in claim 8 wherein said rotatable ball assembly is fabricated of metal.

12. The massage device as recited in claim 8 wherein said liquid is water.

13. The massage device as recited in claim 8 wherein said reservoir is U-shaped.

* * * * *